United States Patent [19]

Thomas

[11] 4,422,595

[45] Dec. 27, 1983

[54] STUD HOLDERS FOR REEL ASSEMBLY

[75] Inventor: Alvin D. Thomas, Valatie, N.Y.

[73] Assignee: Albany International Corp., Menands, N.Y.

[21] Appl. No.: 340,737

[22] Filed: Jan. 19, 1982

[51] Int. Cl.[3] ..... B65H 75/14; B65H 75/22

[52] U.S. Cl. ..... 242/116; 242/118.61

[58] Field of Search ..... 242/116, 118.6, 118.61, 242/118.62, 77.4

[56] References Cited

U.S. PATENT DOCUMENTS

| | | | |
|---|---|---|---|
| 503,227 | 8/1893 | Benham | 242/118.6 |
| 851,367 | 4/1907 | Mossberg | 242/118.6 X |
| 962,453 | 6/1910 | Mossberg | 242/118.6 X |
| 1,977,880 | 10/1934 | Howsam | 242/118.6 X |
| 2,007,705 | 7/1935 | Brugger | 242/118.62 X |
| 2,126,993 | 8/1938 | Howsam | 242/118.6 X |
| 2,605,058 | 7/1952 | Howsam | 242/118.6 X |
| 3,064,715 | 11/1962 | Bland | 156/556 |
| 3,647,252 | 3/1972 | Nolin et al. | 292/357 |
| 3,698,060 | 10/1972 | Helton | 29/200 |
| 3,739,451 | 6/1973 | Jacobson | 29/237 |

*Primary Examiner*—John M. Jillions
*Assistant Examiner*—Scott J. Haugland
*Attorney, Agent, or Firm*—Kane, Dalsimer, Kane, Sullivan & Kurucz

[57] ABSTRACT

A wire reel having an elongated hollow barrel with two circular flanges maintained on respective ends thereof by a plurality of bolts passing through the barrel and flanges and fitted with nuts to secure the flanges to the barrel. To improve assembly of the reel, a stud holder is provided in the barrel's interior which engages the bolts after their passing through a first flange, to align the ends of the bolts with openings in the second flange, facilitating its being placed on the barrel.

5 Claims, 4 Drawing Figures

STUD HOLDERS FOR REEL ASSEMBLY

FIELD OF THE INVENTION

The present invention is directed toward a wire reel, more particularly to a reel construction using carriage bolts and nuts.

BACKGROUND OF THE INVENTION

There presently exists numerous ways of fabricating and assembling wire reels used for wires, cables etc. Single piece and multiple component construction is utilized. In the multiple component arrangement, such as a three piece design including two circular flanges and an elongated barrel held together by nuts and bolts, the assembly of the wire reel usually involves placing the headed end of a number of carriage bolts into a first flange possessing molded square hole to resist rotation of the bolt. The barrel is then placed over the bolts and onto the flange which centers the barrel. The second flange is then placed onto the barrel which to do so requires that the end of the bolts align with and pass into respective holes in the second flange. The assembler has always encountered difficulty in entering the bolts into the second flange because of alignment problems. This therefore requires careful yet cumbersome and time consuming alignment of the bolts in respective holes. Once this is done, pallet nuts are then placed onto the threaded end of the carriage bolts and tightened in a systematic manner to a predetermined torque value.

This means of assembly suffers obvious disadvantages which are further compounded if repair of the reel became necessary requiring a realignment of the bolts when reassembled.

SUMMARY OF THE INVENTION

Accordingly, it is a principal object of the invention to provide for a wire reel which eliminates the disadvantages noted with regard to prior devices.

In this regard, the present invention provides for a wire reel which while constructed of three pieces held together by carriage bolts, includes a stud or jig holder which is maintained at one end of the barrel. In the assembly, after the bolts are placed through the first flange they are snapped into respective stud holders which align the bolts' free end with the holes of the second flange. Since the stud holders are on the similar bolt circle and angle location as the holes in the second flange, this flange fits readily over the bolts with nuts thereafter turned down.

The device advantageously avoids the necessity of the worker having to align the bolts resulting in considerable time saving and provides ease of assembly. Should the wire reel have to be dismantled for repairs, particularly if just the second flange is being replaced, this too is simplified since realignment of the bolts is eliminated.

BRIEF DESCRIPTION OF THE DRAWINGS

The above noted objects and advantages are realized by the present invention the description of which is to be taken in conjunction with the drawings wherein.

DETAILED DESCRIPTION OF THE DRAWINGS

Figure 1:
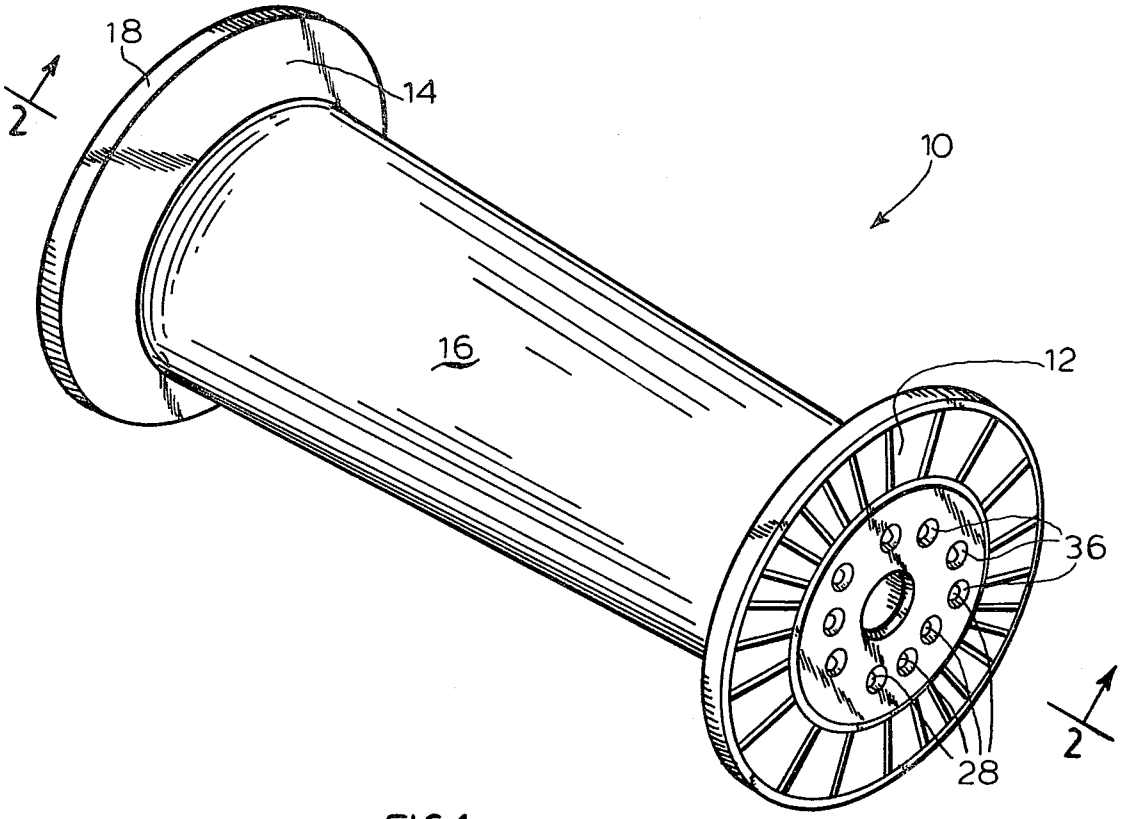
FIG. 1 is a perspective view of a wire reel.

With reference now to the figures, there is shown a wire reel 10 comprising two oppositely positioned circular top and bottom flanges designated 12 and 14 respectively, mounted on an elongated tapering hollow barrel 16. The flanges 12 and 14 and the barrel 16 may be formed in a number of ways. For example they may be molded out of a desired material by using a structural foam process if so desired. High pressure injection molding could also be utilized in this regard, or any other means of fabricaiton suitable for purpose.

The flanges 12 and 14 are of unequal diameter having a flat portion 18 about their periphery for rolling purposes etc. Upon the inner face 20 of the bottom flange 14 is a circular sleeve 22, shown integrally molded therewith, having a diameter of sufficient size to allow its insertion into the bottom end of the barrel 16 and into a bearing relationship with the inner surface 24 thereof. In the assembly, the barrel 16 would be centered on flange 14 by the engagement of the sleeve 22 and surface 24.

The bottom flange 14 is provided with a plurality of openings 26 positioned in a spaced manner about a fixed radius or bolt circle, to allow the passing therethrough of carriage bolts 28 into the interior of the barrel 16. These openings 26 usually would take the form of molded square holes which would resist rotation of the carriage bolt 28 due to the engagement of its head 30 therewith.

Figure 2:
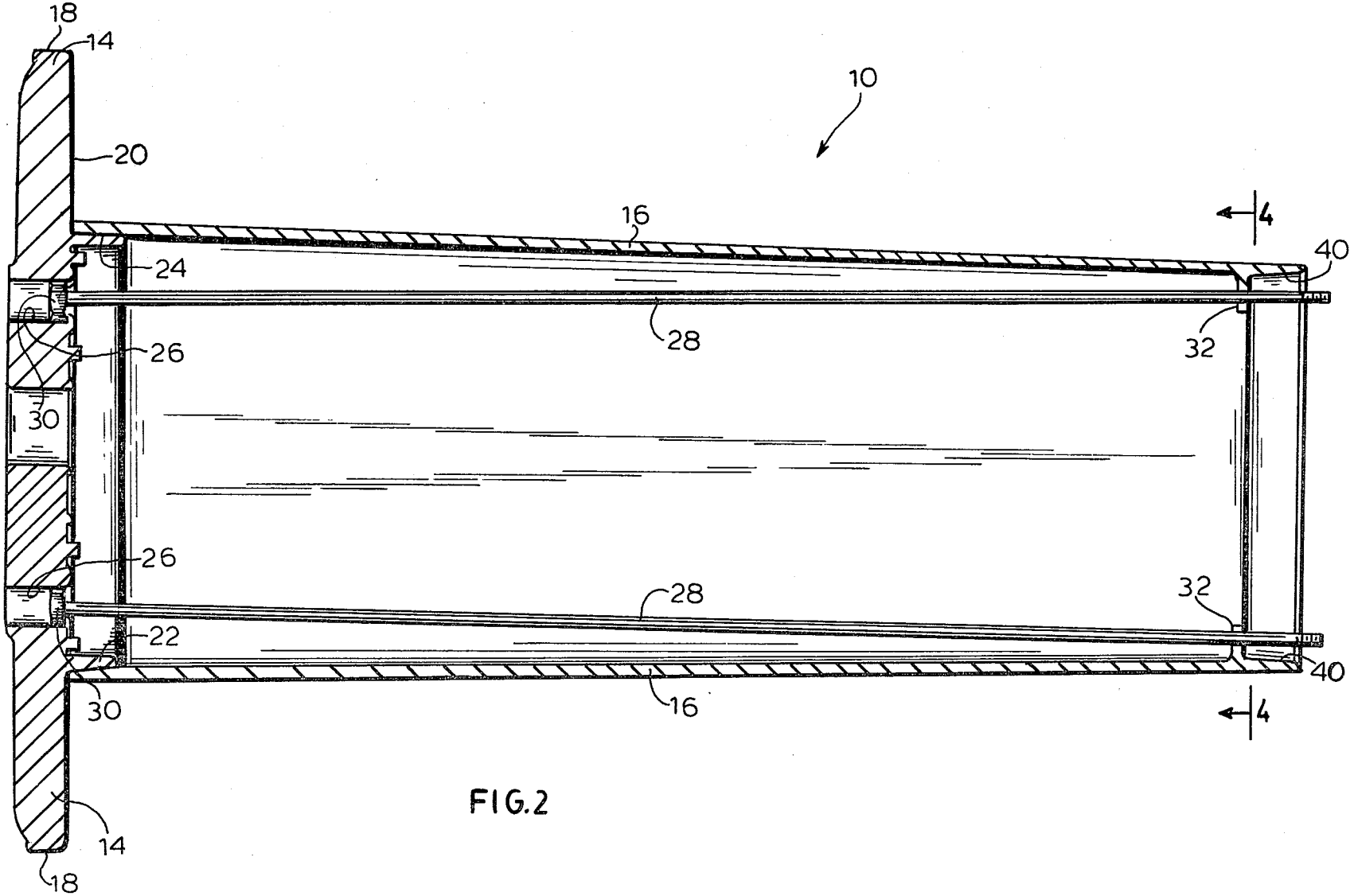
FIGS. 2 and 3 are a sectional view of the wire reel taken along lines 2—2 of FIG. 1 with however the second flange shown detached therefrom.
Figure 4:
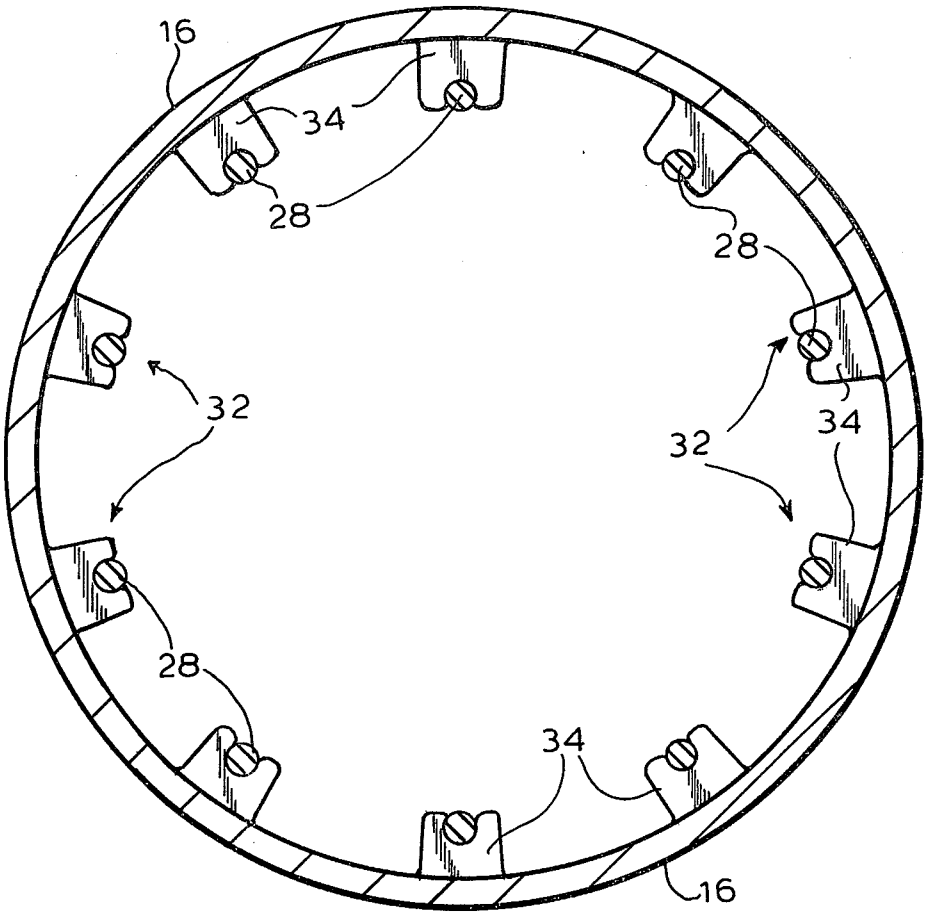
FIG. 4 is a sectional view of the wire reel taken along lines 4—4 of FIG. 2 showing the stud holder.

As can be seen in FIG. 2, the barrel 16 tapers from its bottom to its top end so as to provide a predetermined pitch. Slightly recessed from top end of the barrel 16, there is provided a stud holder or jig 32, shown most clearly in FIG. 4, on the barrel's interior. The stud holder 32 comprises radially extending notched members 34 with the number of notched members 34 corresponding to the number of carriage bolts 28 utilized, i.e., 10 are shown, and may be formed integrally with the barrel 16.

Figure 3:
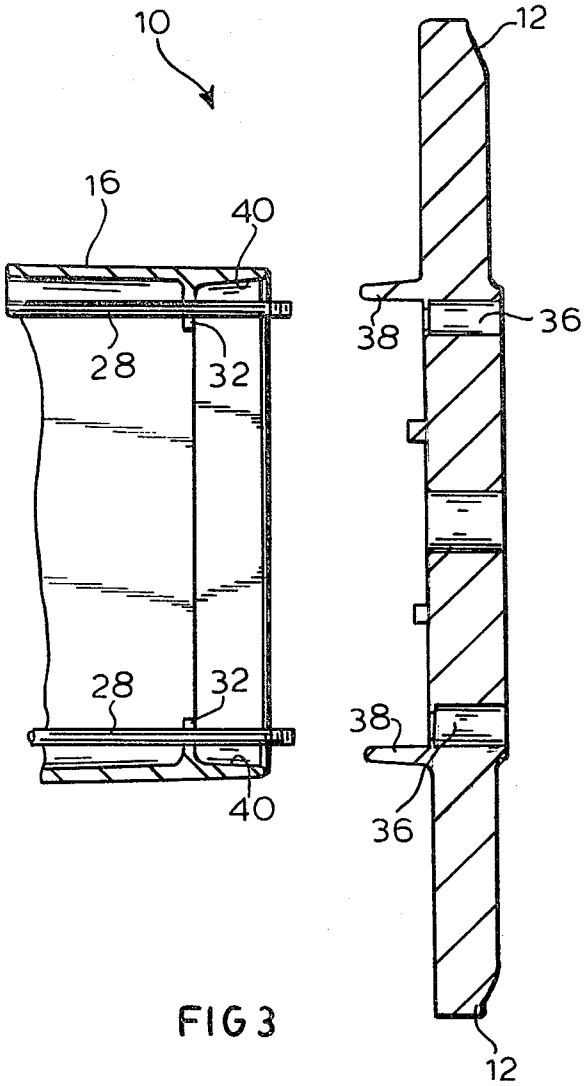

When the bottom flange 14 has been joined with the barrel 16, and the bolts 28 placed therethrough, the assembler would then snap each bolt 28 into a respective notch member 34. The members are on a similar bolt circle and angle location as the holes 36 in the top flange 12, as can be seen in FIG. 3. This automatically aligns the holes so that the top flange 12 can be readily placed on the top end of the barrel 16 with the threaded ends of bolts 28 passing into the holes 36 while annular sleeve 38 engages the inner surface 40 of the barrel 16.

The holes 36 are of sufficient diameter to allow the placement of a pallet nut 42 on the threaded portion of bolt 28, now in hole 36, which are then tightened in a systematic manner to a predetermined torque value.

Should the wire reel 10 require disassembling for repairs etc., this is obviously readily accomplished, with the stud holder 32 aiding in its reassembly, particularly if just the top flange 12 was being replaced, without the necessity of realignment.

Thus by the present invention the aforenoted objects and advantages are readily achieved and although a preferred embodiment has been disclosed and described in detail herein, its scope should not be limited thereby rather its scope should be determined by that of the appended claims.

What is claimed is:

1. A reel for wire or the like, comprising:

a hollow elongated barrel having an interior area;

a first and second flange disposed on respective ends of the barrel;

a plurality of bolt means for maintaining the flanges on the ends of the barrel, said first flange having respective receptacles for a first end of the respective bolt means to be secured thereto, said second flange having respective receptacles for an opposite second end of the respective bolt means to be secured thereto, said bolt means being disposed in said respective receptacles and through said barrel securing said flanges to the barrel; and alignment means disposed on the interior area of the barrel comprising stud holders formed as respective open notched members so as to allow the lateral snap fitting of the bolt means therein and the alignment of the respective bolt means after the insertion of the bolt means into the barrel and accordingly allow for fixedly aligning the respective second ends of the bolt means with respective receptacles in the second flange means thereby facilitating the securing of the second flange to the barrel.

2. The reel in accordance wtih claim 1 wherein said bolt means comprises respective elongated bolts having first ends formed as head ends which are disposed in the receptacle in the first flange and rotationally fixed therein with the opposite second end of the bolts having threaded portions which pass through respective openings in the second flange so as to allow respective nuts to be turned on said thread portion securing the flanges to the barrel.

3. The reel in accordance with claim 2 wherein said barrel is frustoconical in shape having a tapering diameter along its length and said flanges are substantially flat circular plates each having a circular sleeve portion disposed in a bearing relationship with a portion of the barrel's interior area so as to allow the alignment of the barrel and flange.

4. The reel in acordance with claims 1, 2 or 3 wherein said alignment means is situated adjacent to an end of the barrel to which the second flange is secured.

5. The reel in accordance with claim 4 wherein said notch members are formed integrally with the barrel.

* * * * *